US005638565A

United States Patent [19]

Pekar

[11] Patent Number: 5,638,565

[45] Date of Patent: Jun. 17, 1997

[54] INFLATABLE CUSHION

[75] Inventor: Robert W. Pekar, Florence, Mass.

[73] Assignee: Dielectrics Industries, Chicopee, Mass.

[21] Appl. No.: 418,765

[22] Filed: Apr. 7, 1995

[51] Int. Cl.[6] ..... A47C 27/10

[52] U.S. Cl. ..... 5/710; 5/653; 5/654

[58] Field of Search ..... 5/455, 456, 458, 5/654, 449, 710–712, 603

[56] References Cited

U.S. PATENT DOCUMENTS

| | | | |
|---|---|---|---|
| 2,434,641 | 1/1948 | Burns | 5/455 |
| 2,703,770 | 3/1955 | Pekar | 5/458 |
| 4,405,129 | 9/1983 | Stuckey | 5/654 X |
| 5,044,030 | 9/1931 | Balaton | 5/654 X |
| 5,243,722 | 9/1993 | Gusako | 5/455 |

*Primary Examiner*—Michael F. Trettel
*Attorney, Agent, or Firm*—McCormick, Paulding & Huber

[57] ABSTRACT

An inflatable multi-layer body support cushion, adapted to buffer or dampen the fluid reaction to forces applied to the upper surface of the cushion, includes a plurality of adjacent cells of generally hourglass configuration defined by vertically stacked upper and lower chamber portions and medial neck portion. The laterally adjacent chambers are interconnected for the intralayer fluid flow therebetween. The vertically adjacent chambers are interconnected in the neck portion of the cells by orifices which control the interlayer fluid communication between the upper and lower chambers.

16 Claims, 7 Drawing Sheets

INFLATABLE CUSHION

FIELD OF THE INVENTION

This invention relates to body support cushions and, more particularly, to multi-laminar cushions composed of laterally adjacent cells adapted to be inflated with fluid and having vertically stacked upper and lower chambers, with differential fluid communication provided between the cells and chambers that serves to buffer the reaction of the cushion to a force applied downwardly on the upper surface thereof.

BACKGROUND OF THE INVENTION

Inflatable cushions are typically used for low impact applications, such as seat cushions and mattresses; or for high impact applications, such as padding to protect packages during shipment thereof.

Individuals who are confined to a bed or wheelchair for prolonged periods of time are susceptible to developing lesions in the nature of bed sores on the more vulnerable parts of their bodies. These individuals require a stable cushion or mattress that provides generally uniform pressure over the area of the cushion in contact with the individual's body.

When a cushion is used for low impact applications, such as for sitting in a wheelchair, it is desirable that the pressure in the cushion be such as to provide a relatively soft seating surface and yet one that is not overly responsive to sudden movement of the body thereon. It has been learned that when a person moves about on the upper surface of the cushion, a fluid reaction known as "surging" can result in a sudden collapse of the cushion in one area with a resultant rebound or commensurately rapid inflation in another area of the cushion. As a result of such surging and rebound, it is not unusual for the patient to get a feeling of bodily instability and discomfiture.

The seat cushion disclosed by Morner in U.S. Pat. No. 2,495,124 comprises two layers of adjacent inflated cells. Each cell is self-contained and does not communicate with any of the other cells. This type of cushion which does not provide for fluid flow to adjacent cells is unable to evenly distribute the pressure in the cells thereby localizing pressure to the user's body and which may result in bed sores.

The seat cushion disclosed in U.S. Pat. No. 2,434,641 attempts to resolve the problem of individuals developing skin lesions from sitting for protracted periods of time on air support cushions. In the '641 Patent a plurality of bellows of various diameters disposed in the cushion are interconnected. Unfortunately, cushions of this type would be most complicated to manufacture and very costly to manufacture.

U.S. Pat. No. 5,030,501 discloses a protective material comprising a plurality of polygonal air-filled cells which are stiffly resilient and interconnected by a stratum or layer of channels to absorb the air displaced by an impact or blow delivered against one or more of the cells which are collapsed as result of the impact thereon. The venting of the cell(s) is for the purpose of reducing the rebound caused by such impact.

None of the prior art disclosures relate to body support cushions capable of omni-directional buffering action but are limited to uniplanar fluid transference.

SUMMARY OF THE INVENTION

It is the principal object of this invention to provide an inflatable multi-laminar cushion that overcomes the drawbacks of the prior art.

It is another object of this invention to provide an inflatable multi-laminar cushion constructed to buffer the reaction of the fluid flow caused by a force applied to the cushion.

It is a further object of this invention to provide an improved method of forming an inflatable multi-laminar cushion in a single sealing operation.

According to the present invention, an inflatable cushion of multi-laminar construction is composed of a plurality of laterally adjacent or contiguous cells. Each of the cells is generally of hourglass configuration defined by vertically stacked inflated upper and lower chamber portions and medial neck portion. The upper and lower chambers of the cells are disposed in separate layers of the cushion and conduits are disposed to provide intralayer fluid communication at a given flow rate between the upper chamber portions and adjacent cells and between the lower chamber portions and said adjacent cells. Orifices in at least some of said cells which provide interlayer communication directly between at least some of the upper and lower chamber portions and at a different flow rate than said given rate so as to buffer fluid reaction to forces applied to the upper surface of the cushion in a generally downward direction.

The above and other objects and advantages of this invention will become more readily apparent when the following description is read in conjunction with the accompanying drawings.

DETAILED DESCRIPTION OF THE PREFERRED EMBODIMENT

Figure 1:
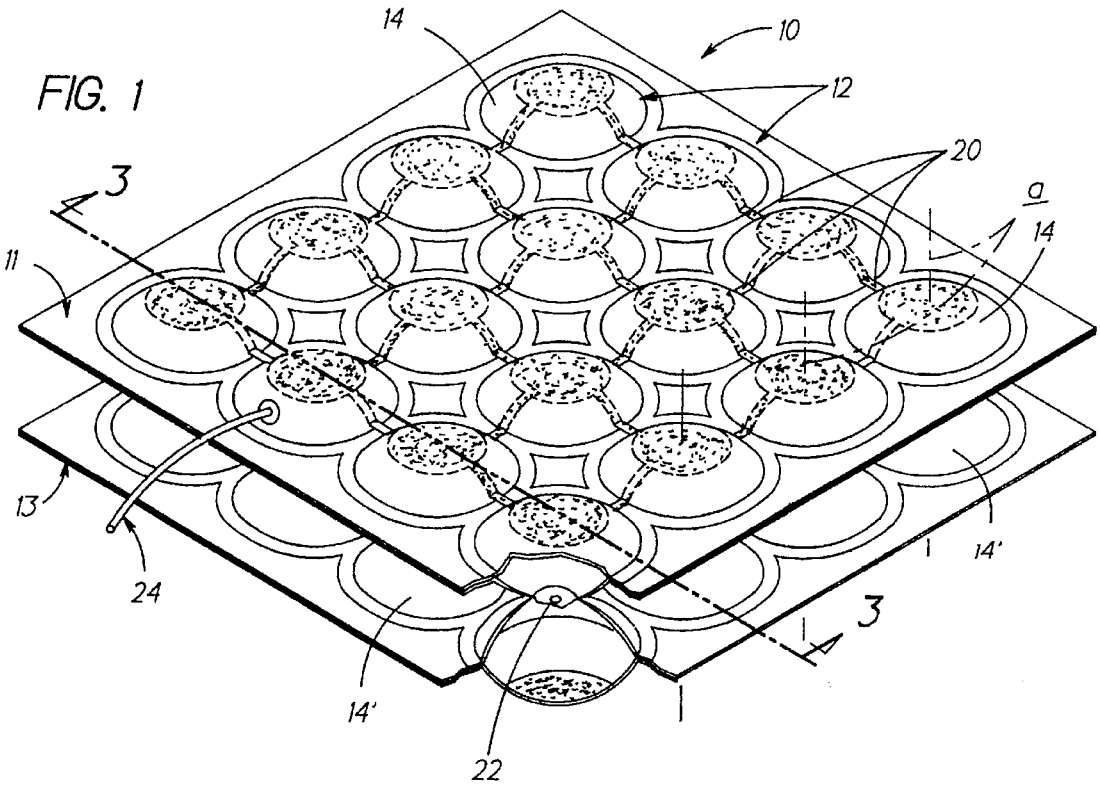
FIG. 1 is a perspective view of an inflatable cushion of the type which embodies the present invention.
Figure 2:
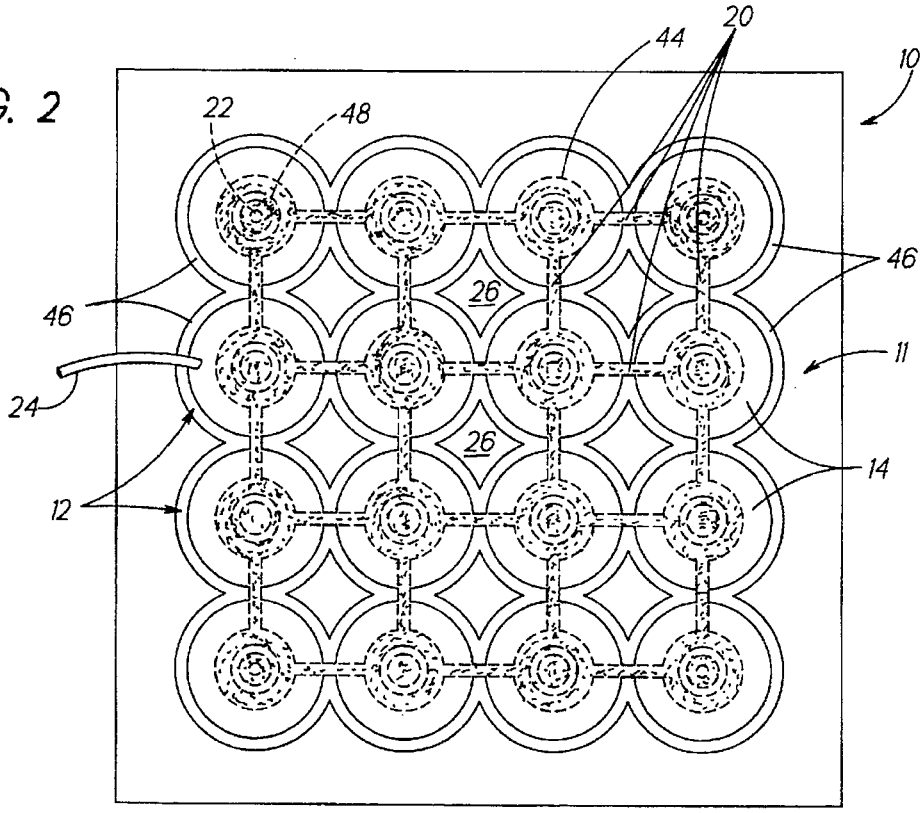
FIG. 2 is a top plan view of the cushion of FIG. 1.
Figure 3:
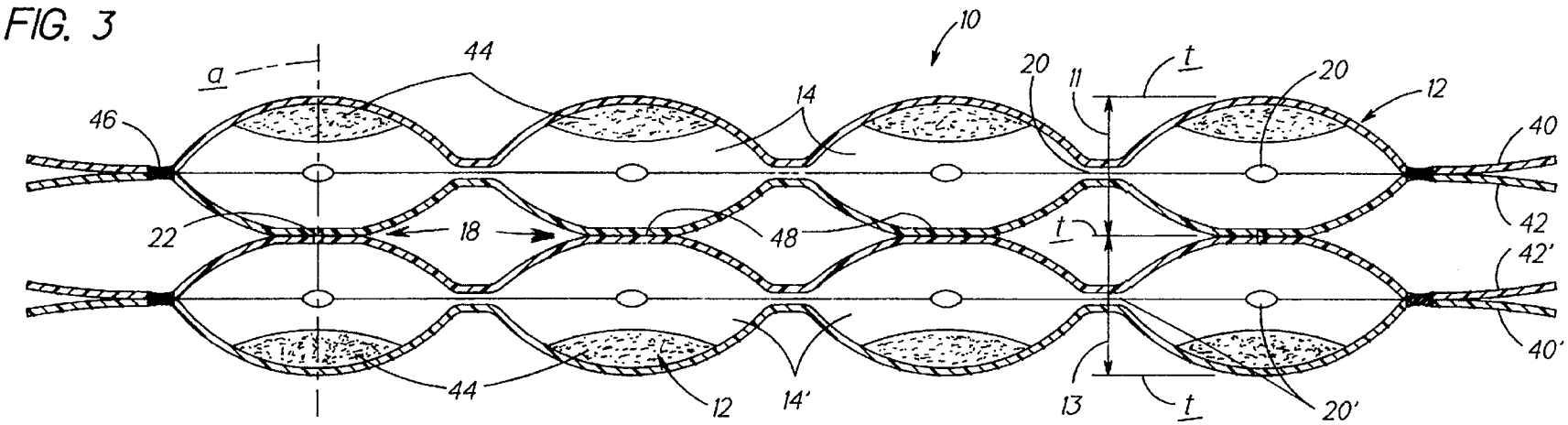
FIG. 3 is a cross-sectional view taken along the line 3—3 of the cushion of FIG. 1.

An inflatable cushion 10 of the type embodying this invention is shown generally in FIGS. 1–3, which is adapted for low impact applications, such as seat cushions, mattresses and the like. Cushions of the same construction may also be adapted for high impact applications, such as protective padding for the soles of shoes and for other types of sporting equipment. As shown, the cushion 10 comprises at least two superimposed and coextensive layers 11 and 13. Each layer is formed by two thermoplastic sheets 40' and 42' selectively sealed, as will hereinafter be more fully described, so as to define by discrete, vertically oriented fluid-filled cells 12. Each of the cells 12, as shown, may be of generally hourglass configuration defined by vertically superposed, or stacked, upper and lower chamber portions 14 and 14' bonded together at their adjacent and central points of tangency which define a medial throat or neck portion 18 disposed therebetween.

Figure 16:
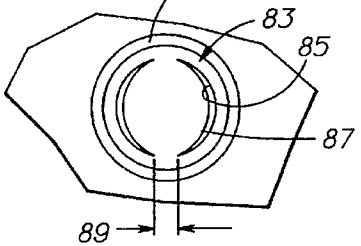
FIG. 16 is a top plan view of an orifice of a cushion of the type embodying this invention.

As seen in FIGS. 1–3, those cells 12 which are horizontally adjacent to one and other and include peripheral edge portions 46 that are disposed in contiguous or abutting relationship. When the cushion is inflated, as shown in FIGS. 1 and 3, the upper and lower surfaces of chambers 14 define the extent of the upper layer 11 as the portion thereof that lay between parallel tangents t, while the chambers 14' similarly define the lower layer 13 of the multi-laminar cushion. Conduits 20 are disposed between unsealed portions of sheets 40 and 42 and as such, are incorporated directly into the layer 11 to provide intralayer fluid communication between the contiguous portions of the upper chamber portions 14. In a similar manner, conduits 20' provide intralayer fluid communication within layer 13 between the lower chamber portions 14' of said adjacent cells 12. The conduits may all be of the same inner diameter (ID) or may vary, as for example, in certain applications in which "bottoming out" is a problem, it may be desirable to have the lower conduits 20' of somewhat smaller ID than the upper conduits. Generally, conduits 20 and 20' for use in cushions of this type would have an ID in the range of 0.0625" to 0.2". However, it should be recognized that in larger structures, such as mattresses, in which each of the cells comprise chambers of much greater cross-section and volume than depicted herein for cushion structures. The intralayer fluid communication need not be restricted in the manner herein disclosed so long as there is controlled interlayer communication vertically between superposed chambers of such mattresses. Indeed, it has been found that a two-way butterfly-type control orifice 83, as shown in FIG. 16, may be approximately 0.75" in diameter which is preferred for this type of application. The orifice 83 comprises an opening of circular configuration 85 which may be partially punched or cut in the throat area of such cells so as to leave the cutout portion of flap 87 in place within the opening 85. The flap 87 remains attached at opposed peripheral edge portions thereof to the corresponding edges of cutout 83 by tabs 89. The tabs 89 extend arcuately over varying dimensions depending upon the amount of free opening to be provided for interlayer control of fluid flow between the upper and lower chambers of the mattress.

In order to provide for interlayer fluid communication directly between the upper chamber portions 14 of the cells 12 in layer 11 and between the lower chamber portion 14', in layer 13, orifices or slits 22 are provided in the neck portions 18 of at least some of said cells 12.

It is an important feature of this invention that there be a substantial differential in the horizontal volumetric flow rate of fluid through the conduits 20 and 20', on the one hand, and the vertical flow rate of the fluid through the orifices or slits 22. In other words, the overall intralayer fluid flow rate and the overall interlayer flow rate are substantially different.

As is well known to those skilled in the art, a downwardly acting force applied to one area of the upper surface of a mattress or cushion-like structure inflated to an appropriate fluid pressure will result in the rapid displacement or "surge" of the fluid from one area of the cushion or mattress to other areas thereof in a wave-like response. Depending on the force applied and the construction of the cushion, or mattress, such surging frequently results in such distortion of the shape thereof sufficient to cause, in some users, feelings of instability and discomfiture. Other problems associated with use of such cushions, particularly in high impact structures, are known in the art as "rebound" and "bottoming out" and generally are the result of a relatively high impact or impulse being delivered on the outer or upper surface of the cushion. In general, these two phenomena are inversely correlated such that if there is a great deal of "rebound", there would be little or no problem with "bottoming out". In this application, the cushion 10, when inflated, has some elastic characteristics such that it will absorb a certain amount of energy in changing its shape upon receipt of an impact or impulse and will thereafter restore this energy upon returning to its original shape.

The upper and lower layers 11 and 13, including, respectively, the chamber portions 14 and 14' is each formed by selectively sealing together two sheets of heat-sealable thermoplastic material. The vertical axes a, or axes of symmetry of the cells 12 are disposed in equi-spaced lateral and longitudinal relationship over the cushion in a generally uniform dimple-pattern of cells. Each cell is preferably of circular configuration c, as best depicted in FIGS. 1–2, but in certain applications, may be rectangular or may be polygonal in configuration. In a sense, the conduits 20 that interconnect adjacent cells 12, form a checkerboard, or grid pattern and the areas delineated by the arcuate portions of adjacent cells result in diamond-shaped areas 26 which, in certain embodiments of this invention, shown in FIGS. 10 and 10A, may be cut out or removed to thereby provide open areas 26' through which temperature-controlled air may be circulated to serve as ventilation for a person resting on the cushion.

In recognition of the fact that comfort is an important feature of the cushion 10 and that the uppermost, or outermost surfaces of the cells 12 provide initial contact with the person's body, it would appear that smoothly curved convex contour of the ellipsoid would be ideal in meeting that criterion. The configuration and support provided by the outer surface of the chambers 14 and 14' are important for those who are confined to a bed or wheelchair for protracted periods, since such persons tend to develop lesions or bed sores on the portions of their body in contact with the mattress or seat thereof. In the embodiment of FIGS. 1–3, the chamber portions are ellipsoidal in configuration but, it will be recognized by those skilled in the art, that the chambers may also be generally spheroidal, ellipsoidal or polygonal in configuration.

The cross-section of each of the conduits 20 and 20' has a predetermined diameter to provide control of the fluid transfer to and from adjacent upper chambers 14 and lower chambers 14' of the cells 12 in both the upper and lower layers 11 and 13 of the cushion to thereby control the rates of the fluid flow between each of the cells 12 of the cushion.

Such control of the lateral or intralayer fluid transfer between the cells 12 provides a buffering or dampening action to the reaction of the fluid in the cells when an external force is applied to the outer surface thereof. The extent of this buffering action can be varied by changing the cross-sectional areas of the conduits 20 and 20'. Depending upon the application, the cross-section of said conduits may vary throughout the cushion if, for instance, the application requires the cells 12 of one portion of the cushion to have a greater dampening effect than the cells of another portion.

Interlayer fluid communication vertically between upper and lower chambers 14 and 14' of the cells 12, is also provided for further buffering fluid flow as a result of a force being applied to the surface of the cushion. Depending on the particular application and the degree of buffering required, the orifices may be provided through merely some of the cells 12 of the cushion. Moreover, the increase of pressure in the lower chambers 14' add support to the upper chambers 14, thus reducing the problem of "bottoming out" of the cushion.

Figure 14:
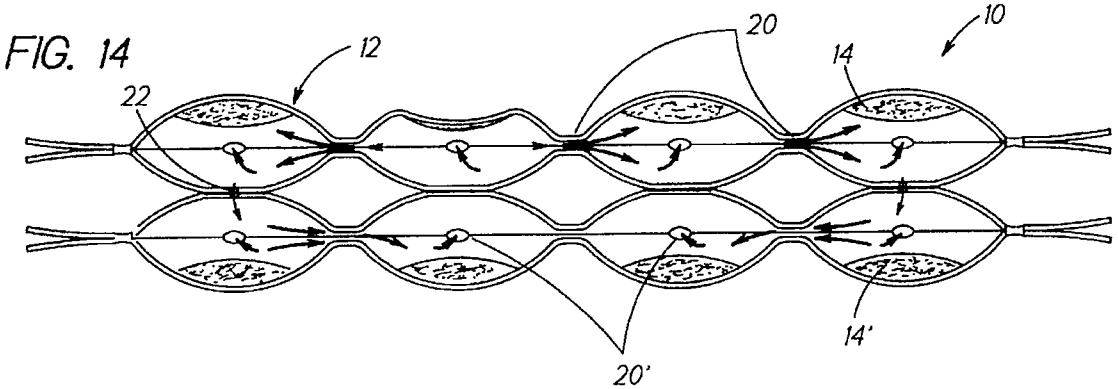
FIG. 14 is cross-sectional view of a cushion of the type embodying this invention being used in a manner to illustrate the buffering action of a cushion of the type embodying this invention.

As depicted in the graphic illustration of FIG. 14, the orifices 22, each of which is preferably formed as a slit. Generally, each of the orifices 22 is substantially smaller than the cross-sectional area than the area of the conduits 20' such that vertical, or interlayer volumetric rate of flow within the cells and between layers is substantially less than the horizontal or intralayer volumetric rate of flow in the conduits 20 and 20' of the cushion. It is also within the scope of this invention that the overall cross-sectional area of the orifices that control vertical interlayer fluid flow between the upper and lower chambers 14 and 14' of the cells be smaller than the overall cross-sectional area of the conduits 20 which provide for the horizontal intralayer volumetric fluid flow between the upper chambers 14 and between the lower chambers 14' of adjacent cells 12. Indeed, it has been found that such controlled transference of the fluid to the lower chambers 14' increase the dampening or buffering response of the cushion to an external force applied to the outer surface thereof.

Figure 4:
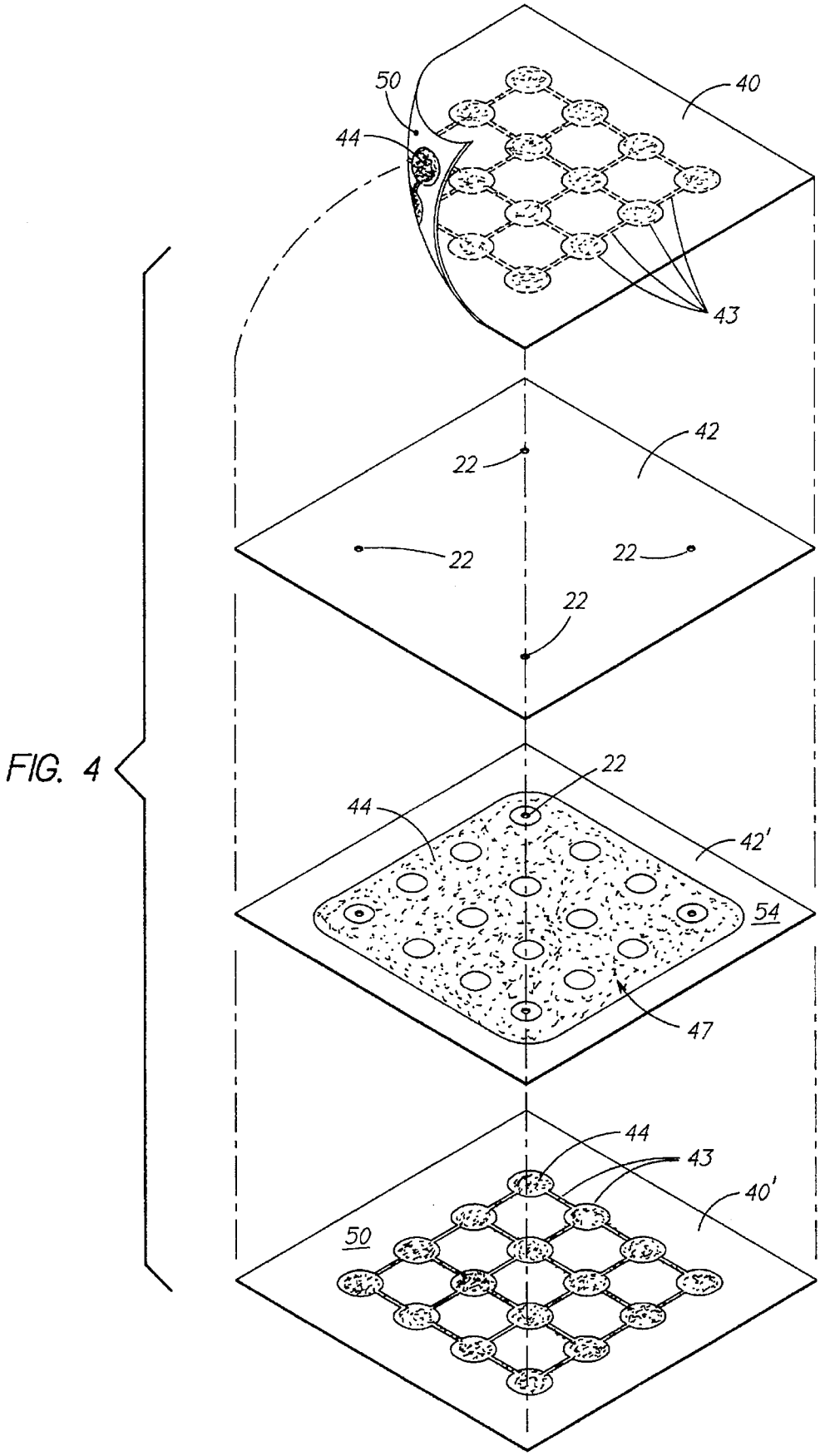
FIG. 4 is an exploded perspective view illustrative of the method of manufacture of a cushion of the type embodying this invention.

Cushions of the type embodying this invention are illustrated at 10 in FIG. 1 and preferably are formed, as depicted in FIG. 4, in a single sealing operation by selective sealing of a first pair of thermoplastic sheets 40 and 42 which form the upper layer 11 and a second pair of identical sheets 40' and 42' which form the lower layer 13 of the cushion.

In the sealing operation, each pair of thermoplastic sheets 40 and 42 and 40' and 42' are superimposed in face-to-face relation on sealing dies which generally replicate the horizontal pattern of the cells, as shown in FIG. 2. The dies may be of any suitable type, such as utilize RF or thermal energy to seal the sheets peripherally and at other uncoated locations preselected for sealing. The inner surfaces 50 of each of the outer sheets 40 and 40' are coated with release material 44 which will prevent the sealing together of those portions of the sheets 43 that conform to the location of the upper and lower chambers of the cells 12 and the conduits 20 and 20'. The inner surface 54 of the intermediate sheet 42' is coated with release material 44 which will prevent the sealing together of that portion 47 of the sheets 42 and 42' about the area 45 through which the orifices are to be formed. The orifices 22 are cut into the intermediate layers 42 at predetermined locations prior to the sealing procedure.

The barrier coating or release material 44 may be applied, such as disclosed in my earlier U.S. Pat. No. 5,022,109, by conventional printing techniques, such as silk screening, rotogravure of flexographic process. Preferably, the coatings are applied as a composition in a liquid dispersion medium of an organic solvent or water base with a dispersed phase of finely divided microscopic particles of a polyethylene, a polytetrafluoroethylene (Teflon) or silicone on the order of five microns in diameter. With the release material firmly bonded to the sheets 40, 40' and 42', the polyethylene, Teflon or silicone particles thereof will inhibit the sealing of the coated areas in the abutted portions of the two sheets engaged by the sealing dies.

The outer seal 46 welds or fuses the outer sheet 40 and 40' to the intermediate sheets 42 and 42' to form upper and lower chambers 14 and 14' of the cells and the inner seal 48 seals the intermediate sheets 42 and 42' together to thereby connect the upper and lower chambers to form the cells' hourglass shape.

The inflation means, as shown, is in the form of a tube 24 that may be sealed to an opening in the cushion during manufacture of the cushion. In addition, it is also feasible and within the context of this invention, to utilize a one-way check valve capable of serving as an inflation portion for the cushion.

Figure 5:
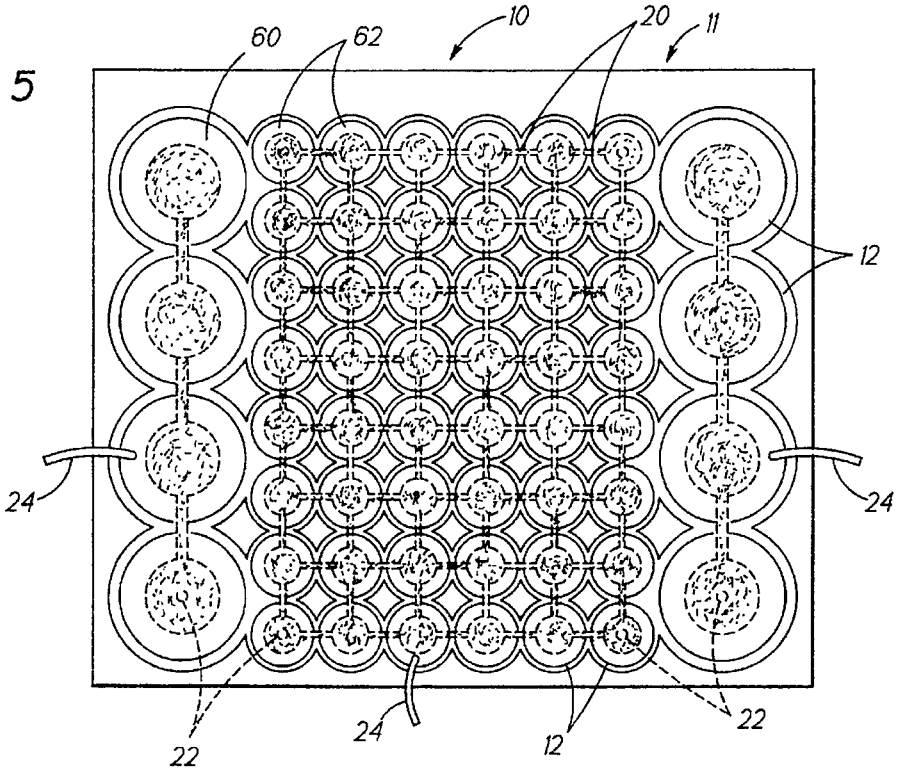
FIG. 5 is a top plan view of an alternative embodiment of the cushion of FIG. 1.

An alternative embodiment of the cushion 10, as illustrated in FIG. 5, has cells 12 of various sizes or diameters. The firmness of a particular chamber of a cell is inversely proportional to the volume thereof, therefore, the larger sized chambers 60 provide a softer cushion than the smaller sized chambers 62. Chambers of various sizes may be strategically disposed to provide a firmer or softer cushioned area. In addition, the convex surface of the larger chambers expand to a greater height above the horizontal surface of the cushion than the convex surface of the smaller chambers. The larger chambers may be disposed along the outer edges of the cushion, as shown in FIG. 5, to cradle an individual sitting thereon.

Figure 6:
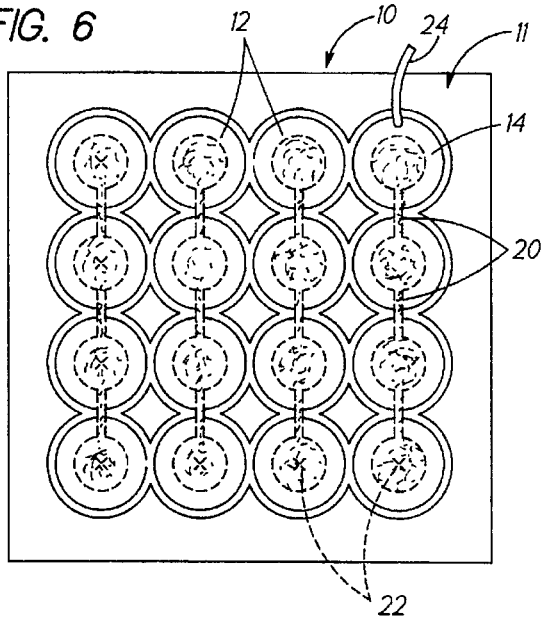
FIG. 6 and 7 are top and bottom plan views respectively showing another alternative embodiment of a cushion of the type embodying this invention.
Figure 7:
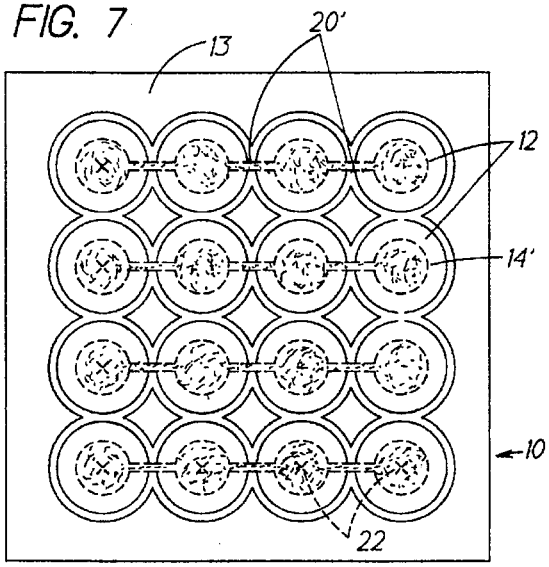

In the embodiment of FIGS. 6 and 7, the conduits 20 and 20' interconnect adjacent upper and lower chambers 14 and 14' to form individual rows of communicating chambers. The rows of upper chambers are oriented perpendicular to the rows of lower chambers. The control orifices 22 are disposed within the cells along two adjacent edges of the cushion 10 to permit fluid communication between all chambers.

It has been found that by configuring the conduits 20 and 20', as shown in FIGS. 6 and 7, the dampening or buffering of the transference of fluid can be increased to provide a more stable cushion 10. The time to transfer the fluid and equalize the pressure throughout the cushion is increased due to the limited number of fluid paths. To equalize the pressure after a downward force has been applied to an upper chamber, the fluid first flows to the upper chambers 14 disposed in its row, then passes through an orifice 22 to a row of lower chambers 14', then back through the orifices 22 in the said row to the remaining rows of upper chambers 14, and finally back through the remaining orifices to the remaining rows of lower chambers.

Figure 8:
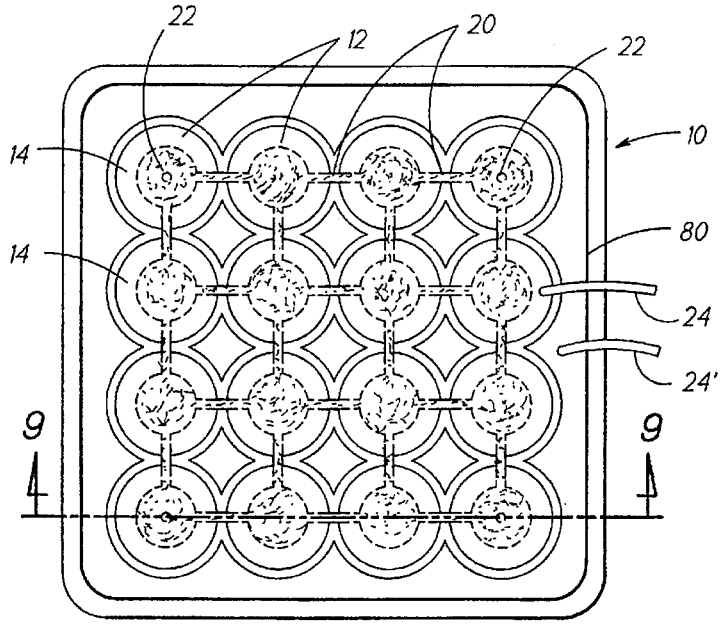
FIG. 8 is a top plan view of yet another alternative embodiment of a cushion of the type embodying this invention.
Figure 9:
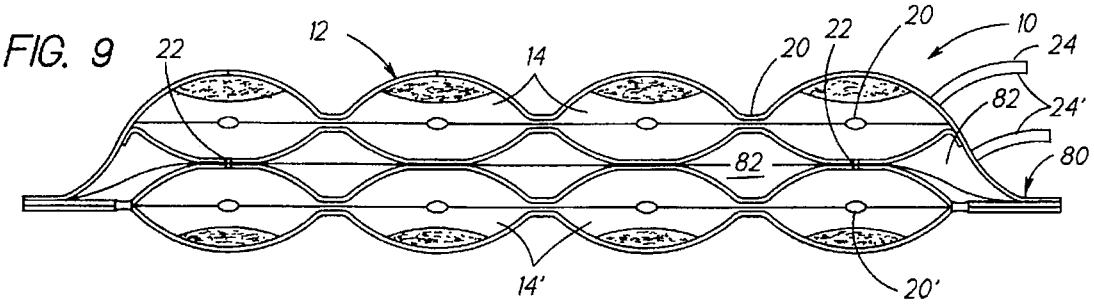
FIG. 9 is a cross-sectional view taken along the line 9—9 of FIG. 8.

In the embodiment illustrated in FIGS. 8 and 9, the outer layers 40 are sealed along the outer periphery of the cushion at 80 to form an intermediate chamber 82 defined by the void between the cells 12. The intermediate chamber may be filled or inflated with a fluid such as air, liquid or gel by an inflation means 24'. The intermediate layer may also be inflated at a high pressure and the cells be inflated at a relatively low pressure to form a generally firm cushion with a softer upper surface. Inflation of the intermediate layer also reduces the likelihood of the cushion from "bottoming out".

Figure 10:
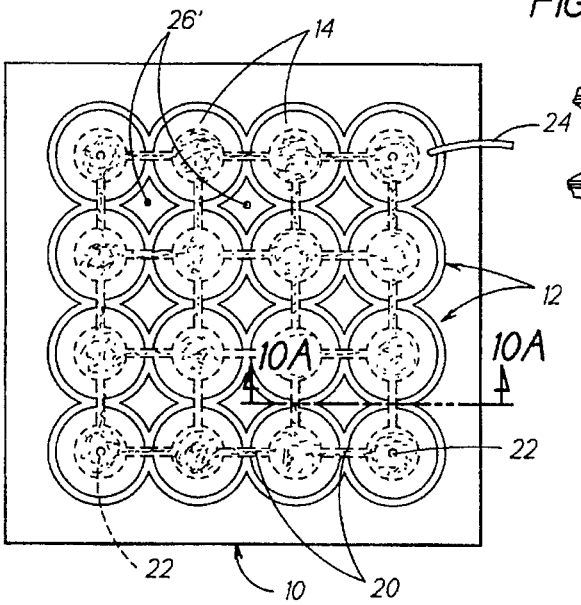
FIG. 10 is a top plan view of still another alternative embodiment of a cushion of the type embodying this invention.
Figure 10A:
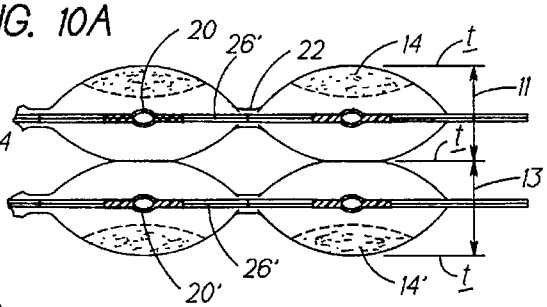
FIG. 10A is a cross-sectional view taken along line 10A—10A of FIG. 10.

Due to the long periods of contact with the cushion 10, a significant amount of heat can build up causing the body of the user contacting the cushion to perspire. The embodiment in FIGS. 10 and 10A illustrates a means to ventilate the cushion, as briefly discussed hereinbefore. The diamond-shaped portions 26' of the cushion 10 interposed between the cells 12 are cut out to permit air to pass between the user and cushion. The cushion 10 acts as a pump by drawing air into the void 26' between the cells 12 when the cells inflate and forcing air from the void through the cutouts 26' when the cells are compressed.

Figure 11:
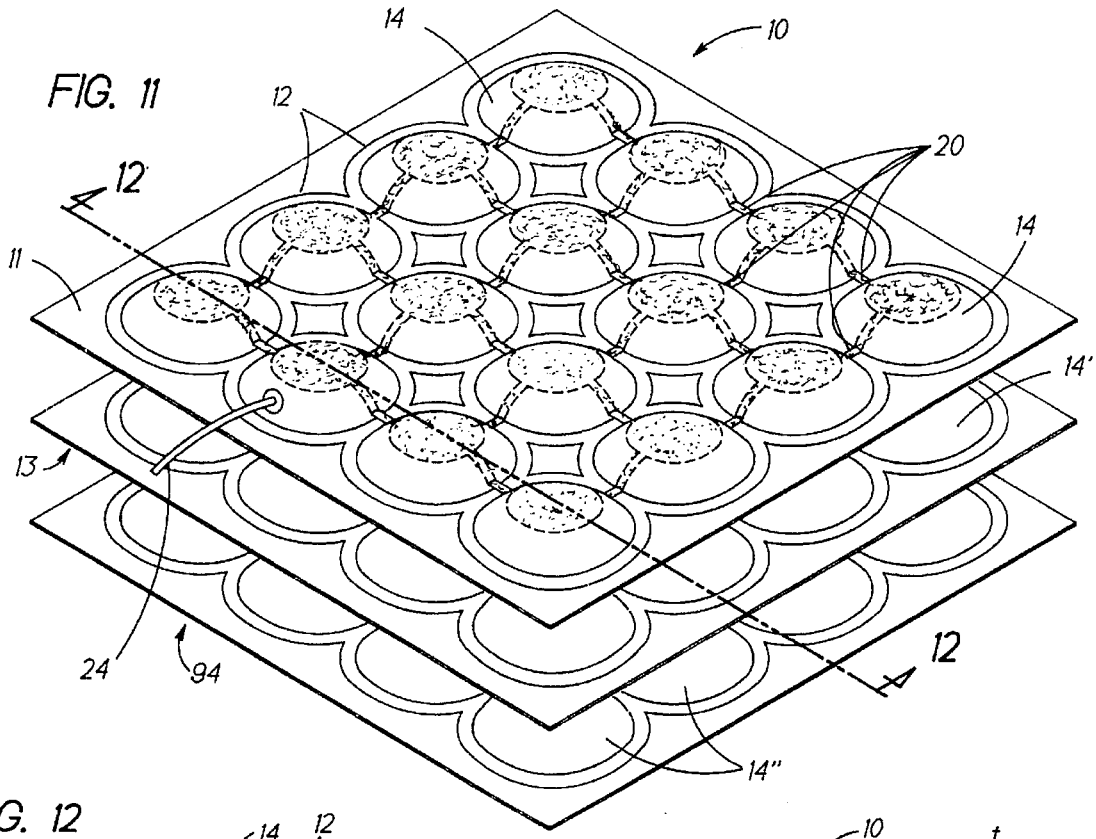
FIG. 11 is a perspective view of a sixth alternative embodiment of a cushion of the type embodying this invention.
Figure 12:
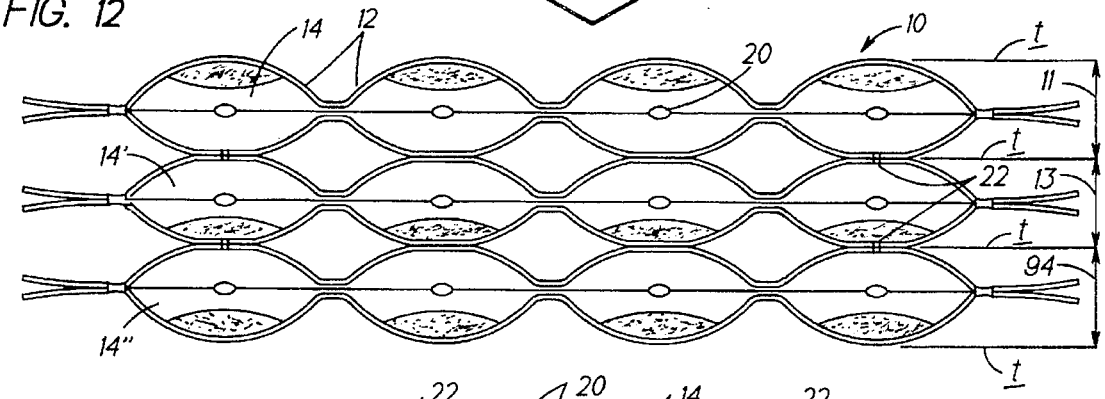
FIG. 12 is a sectional view taken along line 12—12 of FIG. 11.

The embodiments in FIGS. 11 and 12 show a cushion 10 having three inflatable layers 11, 12 and 94 comprising a plurality of adjacent cells having three vertically stacked chambers. The third or bottom chamber 14" may communicate with the other two chambers 14 and 14' to increase the dampening of the cushion or may be isolated therefrom to permit the third layer to be independently inflated to provide a firm base cushion and reduce the likelihood of "bottoming out".

Figure 13:
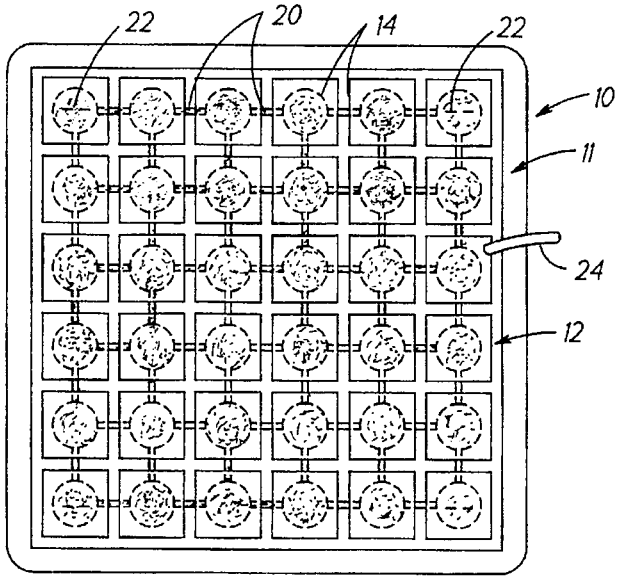
FIG. 13 is a top plan view of a seventh alternative embodiment of a cushion of the type embodying this invention.

FIG. 13 illustrates another embodiment of the invention having the cells 12 with square-shaped chambers in abutting relationship such that no spaces 26 exists therebetween as shown in FIG. 1.

Figure 15:
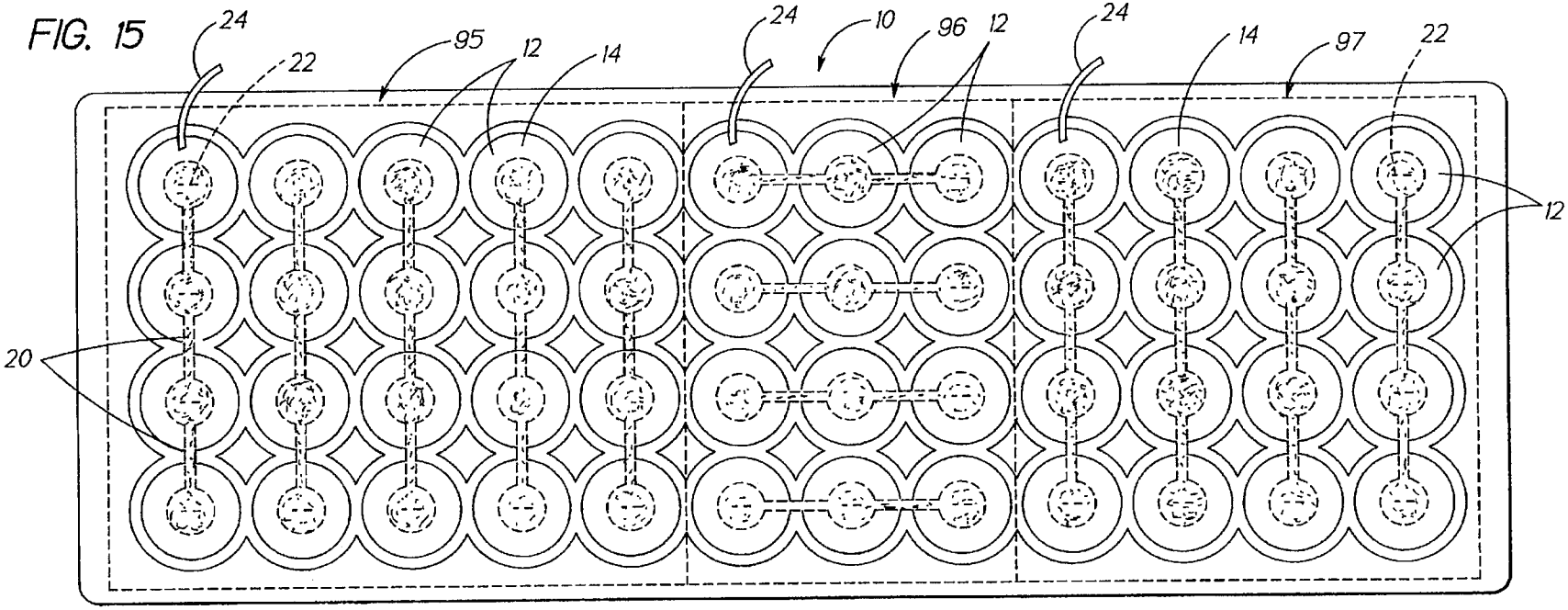
FIG. 15 is a top plan view of an eighth alternative embodiment of a cushion of the type embodying this invention.

The cells 12 of the cushion 10 may be interconnected to provide separate zones of inflation 95, 96 and 97, as shown in the embodiment in FIG. 15. This feature is important for applications which require portions of the cushion to be of greater pressure than others. For instance, a cushion used as an inner sole of a shoe may require a firm cushion at the heel of the foot and a softer cushion at its forefoot or arch.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. An inflatable cushion comprising a plurality of fluid filled layers formed of sheets of flexible material, each layer comprising a plurality of chambers arranged in adjacent side-by-side relationship to each other, said chambers of a layer disposed in vertically stacked and abutted relationship to said chambers of an other layer defining a cell, at least one cell including an orifice disposed directly between at least one pair of said vertically stacked chambers to provide predetermined volumetric flow rate for controlled interlayer fluid communication when said cells are subjected to a compressive load.

2. An inflatable cushion, as set forth in claim 1, in which at least some of said adjacent chambers in at least one of said layers are interconnected by conduits which provide intralayer fluid communication therebetween, the cross-sectional area of said conduits being related to the cross-section area of said orifices such that in response to said compressive load being applied to an upper surface portion of said cushion, the intralayer volumetric flow rate and the interlayer flow rate between the chambers of said cells are controlled to buffer the internal fluid in response of said cushion to said load.

3. An inflatable cushion, as set forth in claims 1 or 2, in which said cushion is permanently inflated so that it need not be reinflated during the intended use thereof.

4. An inflatable cushion, as set forth in claims 1 or 2, in which said cushion includes means for inflating the chambers of said cushion.

5. An inflatable cushion, as set forth in claims 1 or 2, in which said chambers are spheroidal in shape.

6. An inflatable cushion, as set forth in claims 1 or 2, in which said layers of sheet material are sealed about the outer peripheral edges thereof to form an independent generally closed intermediate chamber between the inflatable layers of said cushion.

7. An inflatable cushion, as set forth in claim 6, further including a second inflation means for independently inflating said intermediate chamber.

8. An inflatable cushion, as set forth in claims 1 or 2, in which each of said cells comprises two vertically stacked chambers.

9. An inflatable cushion, as set forth in claims 1 or 2, in which said chambers are ellipsoidal in shape.

10. An inflatable cushion, as set forth in claims 1 or 2, in which said chambers are polygonal in shape.

11. An inflatable cushion comprising a plurality of fluid filled cells formed of sheets of flexible material, each of said cells including a plurality of chambers disposed in vertically stacked and abutted relationship to each other, said cells arranged in adjacent side-by-side relationship to each other to form a plurality of inflatable layers defined by each of said vertically stacked chambers of said cells, at least one cell including an orifice disposed directly between at least one pair of said vertically stacked chambers, at least some of said adjacent chambers in at least one of said layers are interconnected by conduits which provide intralayer fluid communication therebetween.

12. An inflatable cushion, as set forth in claims 1 or 2, wherein areas between contiguous chambers in each of said layers are perforated to provide paths for the passage of air into, through and out of said cushion to provide ventilation to the portion of the body dispose thereon.

13. An inflatable cushion, as set forth in claims 1 or 2, further comprising a plurality of separate inflation zones, each zone including at least one cell, whereby said cell of each zone is fluidly isolated from said cell of each other zone.

14. An inflatable cushion, as set forth in claim 13, further comprising inflation control means for alternately inflating different inflation zones of said cushion at sequential timed relationship for varying the pressure points on a body resting on said cushion.

15. An inflatable cushion, as set forth in claims 1 or 2, in which said chambers vary in size in different areas of the cushion.

16. An inflatable cushion, as set forth in claims 1 or 2, wherein said adjacent chambers of a first layer interconnected to form individual rows of communicating chambers, said adjacent chambers of a second adjacent layer interconnected to form individual rows of communicating chambers, said rows of said first layer arranged generally .perpendicular to said rows of said second layer.

* * * * *